US010151459B2

(12) United States Patent
Meyer

(10) Patent No.: US 10,151,459 B2
(45) Date of Patent: Dec. 11, 2018

(54) LED HOLDER

(71) Applicant: Molex, LLC, Lisle, IL (US)

(72) Inventor: Gregory P. Meyer, Elk Grove Village, IL (US)

(73) Assignee: Molex, LLC, Lisle, IL (US)

( * ) Notice: Subject to any disclaimer, the term of this patent is extended or adjusted under 35 U.S.C. 154(b) by 155 days.

(21) Appl. No.: 15/034,776

(22) PCT Filed: Nov. 6, 2014

(86) PCT No.: PCT/US2014/064338
§ 371 (c)(1),
(2) Date: May 5, 2016

(87) PCT Pub. No.: WO2015/069889
PCT Pub. Date: May 14, 2015

(65) Prior Publication Data

US 2016/0327248 A1 Nov. 10, 2016

Related U.S. Application Data

(60) Provisional application No. 61/900,992, filed on Nov. 6, 2013.

(51) Int. Cl.

| | |
|---|---|
| ***F21V 15/00*** | (2015.01) |
| ***F21V 19/00*** | (2006.01) |
| ***F21S 8/00*** | (2006.01) |
| ***F21V 23/06*** | (2006.01) |
| *F21Y 115/10* | (2016.01) |

(52) U.S. Cl.
CPC ..... *F21V 19/005* (2013.01); *F21S 8/031* (2013.01); *F21V 19/0025* (2013.01); *F21V 19/0055* (2013.01); *F21V 23/06* (2013.01); *F21Y 2115/10* (2016.08)

(58) Field of Classification Search
CPC .... F21V 19/005; F21V 19/0055; F21V 23/06; F21V 19/0025; F21S 8/031; F21Y 2115/10
See application file for complete search history.

(56) References Cited

U.S. PATENT DOCUMENTS

| | | | | |
|---|---|---|---|---|
| 9,146,027 | B2 | 9/2015 | Zantout et al. | |
| 2002/0149930 | A1* | 10/2002 | Parker | F21L 4/045 362/206 |
| 2003/0001715 | A1* | 1/2003 | Montague | H01R 13/4534 337/198 |
| 2004/0252496 | A1* | 12/2004 | Dalton | F21L 4/005 362/198 |
| 2005/0207176 | A1* | 9/2005 | Johnson | B60Q 1/0088 362/545 |

(Continued)

*Primary Examiner* — Thien T Mai
(74) *Attorney, Agent, or Firm* — Jeffrey K. Jacobs

(57) ABSTRACT

A holder is provided to support a light emitting diode (LED) array in position. In an embodiment the holder includes a terminal that is insert-molded into a housing. In an alternative embodiment, a terminal can be stitch into a housing and secured with a shield. In the latter embodiment the holder can be configured to provide a desired amount of electrical isolation between the terminal and potential shorting surfaces so as to meet creepage and clearance requirements, thus allowing the use of additional power supplies.

9 Claims, 12 Drawing Sheets

(56) References Cited

U.S. PATENT DOCUMENTS

| | | | | |
|---|---|---|---|---|
| 2011/0063849 | A1* | 3/2011 | Alexander | F21V 19/001 362/294 |
| 2011/0075419 | A1 | 3/2011 | Park | |
| 2012/0020086 | A1 | 1/2012 | Kataoka | |
| 2012/0159777 | A1* | 6/2012 | Fletcher | H01R 24/78 29/825 |
| 2012/0223632 | A1* | 9/2012 | Hussell | F21K 9/56 313/483 |
| 2013/0027193 | A1 | 1/2013 | Dai | |
| 2013/0044501 | A1* | 2/2013 | Rudisill | F21V 29/004 362/398 |
| 2013/0084748 | A1 | 4/2013 | Zaderej et al. | |
| 2014/0185278 | A1* | 7/2014 | Burkart | F21V 33/008 362/183 |
| 2014/0213094 | A1* | 7/2014 | Rowlette | F21V 19/0035 439/366 |
| 2014/0254179 | A1* | 9/2014 | Miletich | F21S 8/04 362/373 |
| 2014/0307441 | A1* | 10/2014 | Wu | F21V 31/005 362/267 |

* cited by examiner

LED HOLDER

RELATED APPLICATIONS

This application is a National Phase application of PCT/US2014/064338 filed on Nov. 6, 2014 and claims the benefit of priority to U.S. Provisional Application No. 61/900,992, filed Nov. 6, 2013, both of which are incorporated herein by reference in their entirety.

TECHNICAL FIELD

This disclosure relates to field of solid state lighting, more specifically to holders for light emitting diode (LED) arrays.

DESCRIPTION OF RELATED ART

Light emitting diode (LED) arrays are known to be well suited for use in general illumination applications. One issue that exists as LED arrays have gotten more efficient is that the LED array has gotten smaller. This has made certain methods of supporting and securing LED arrays that previously were beneficial become somewhat less desirable. LED holders have therefore become more useful in LED array applications, particularly those applications that have chip-on-board (COB) style LED arrays. Existing designs, while well suited to certain applications, are not always desirable or compatible with the preferred manufacturing process. Therefore, certain individuals would appreciate further improvements in LED holder systems.

SUMMARY

Embodiments of LED holders are disclosed. In a first embodiment, a holder includes terminals that are insert-molded into a housing that includes a receptacle on a top side and socket on a bottom side. A pocket is formed in the socket. The housing is formed so that the terminals have a contact positioned above a pocket and a male contact positioned in a receptacle.

A second embodiment of a holder includes a housing that is formed with a light aperture, a recess and a receptacle. A ledge is provided in the recess and a terminal can be positioned on the ledge. The terminal can include a female contact and a male contact. An aperture in the housing allows the female contact to extend into a LED socket while the male terminal is positioned in a receptacle. A shield is positioned in the recess and the shield covers the terminal. The shield can help define the light aperture in the holder as well as back edge of the receptacle. The shield can be heat stacked into the recess.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
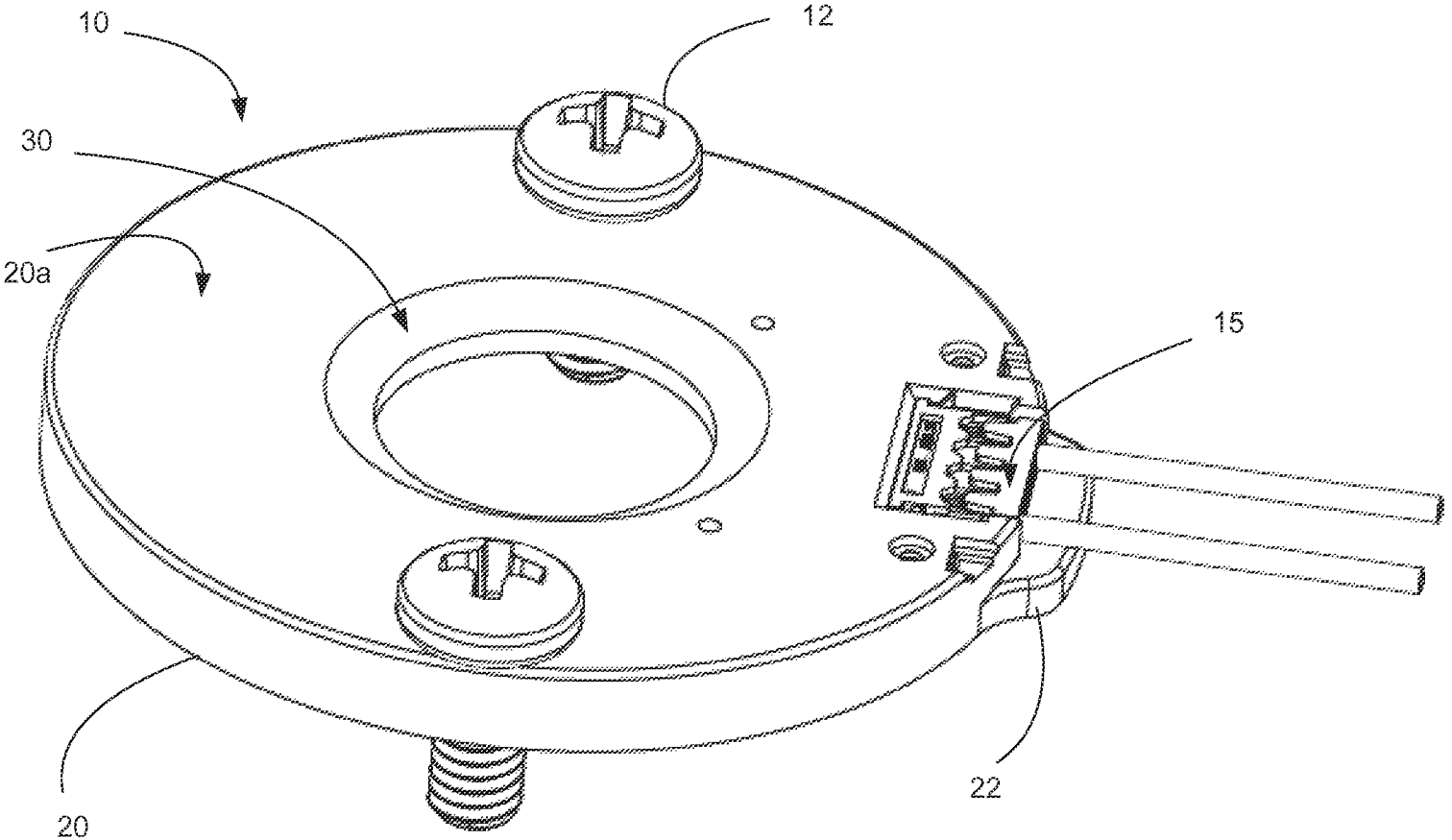
FIG. 1 illustrates a perspective view of a first embodiment of an LED holder system.
Figure 2:
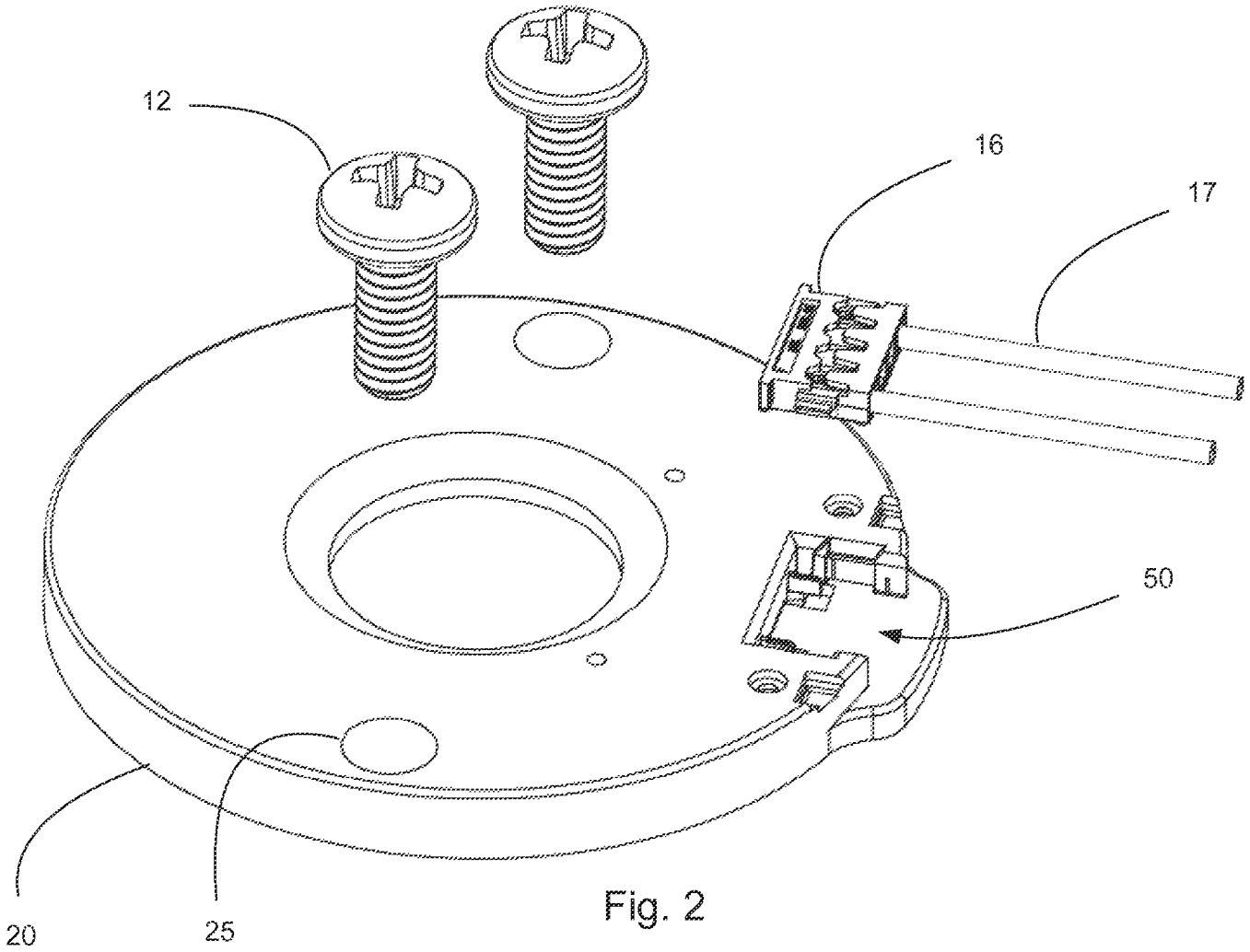
FIG. 2 illustrates a partially exploded perspective view of the embodiment depicted in FIG. 1.
Figure 3:
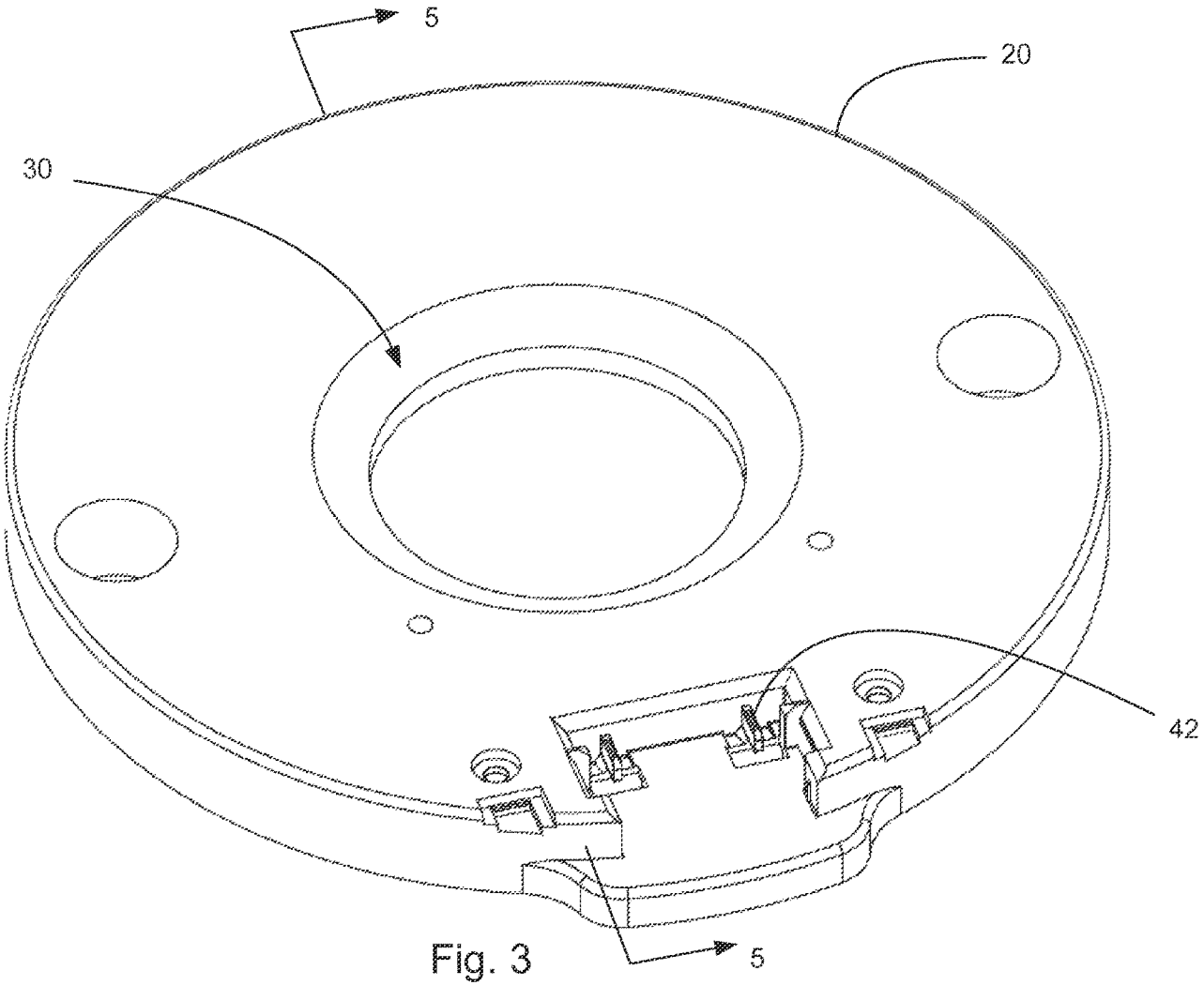
FIG. 3 illustrates a perspective view of a holder assembly.
Figure 4:
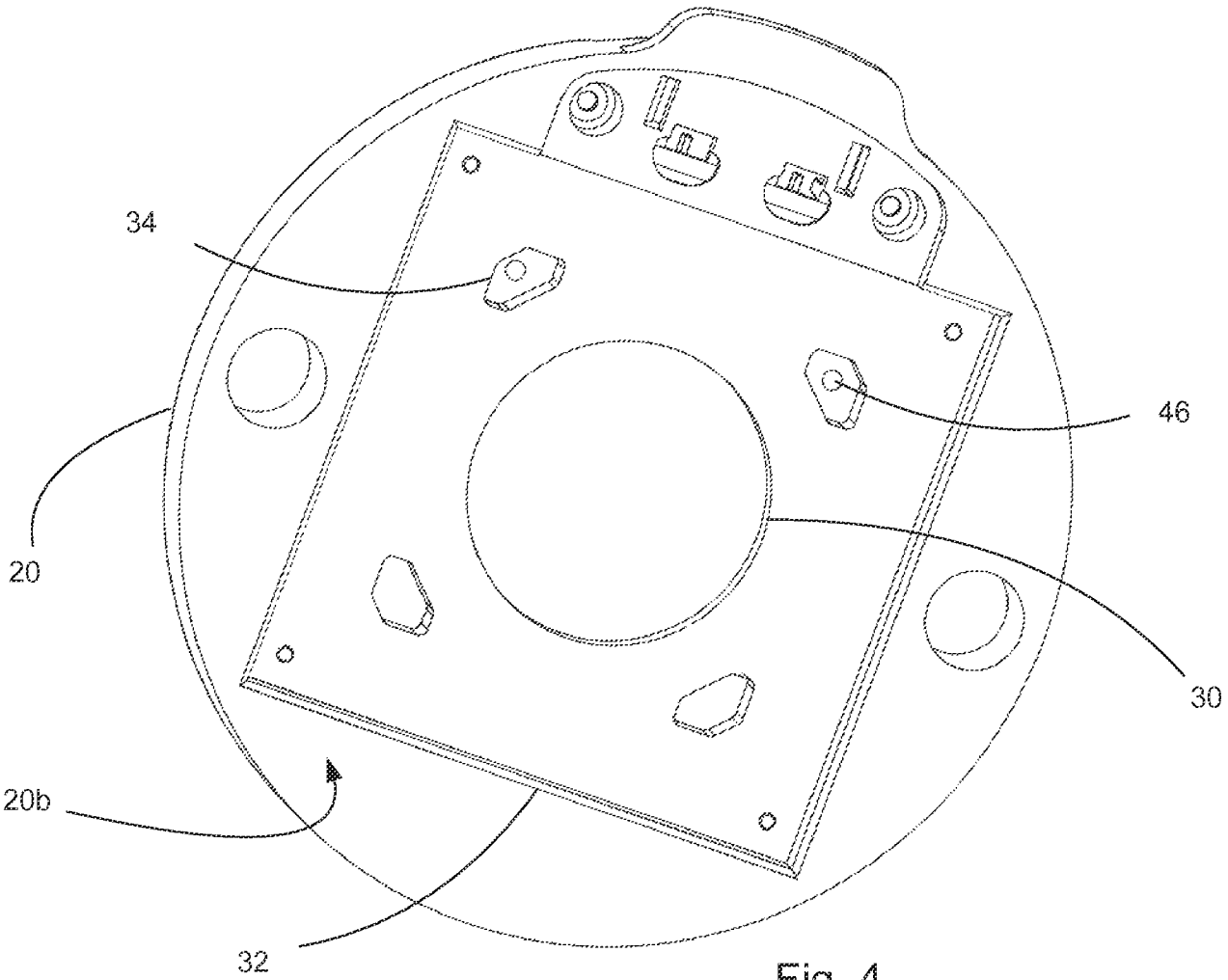
FIG. 4 illustrates another perspective view of the embodiment depicted in FIG. 3.
Figure 5:
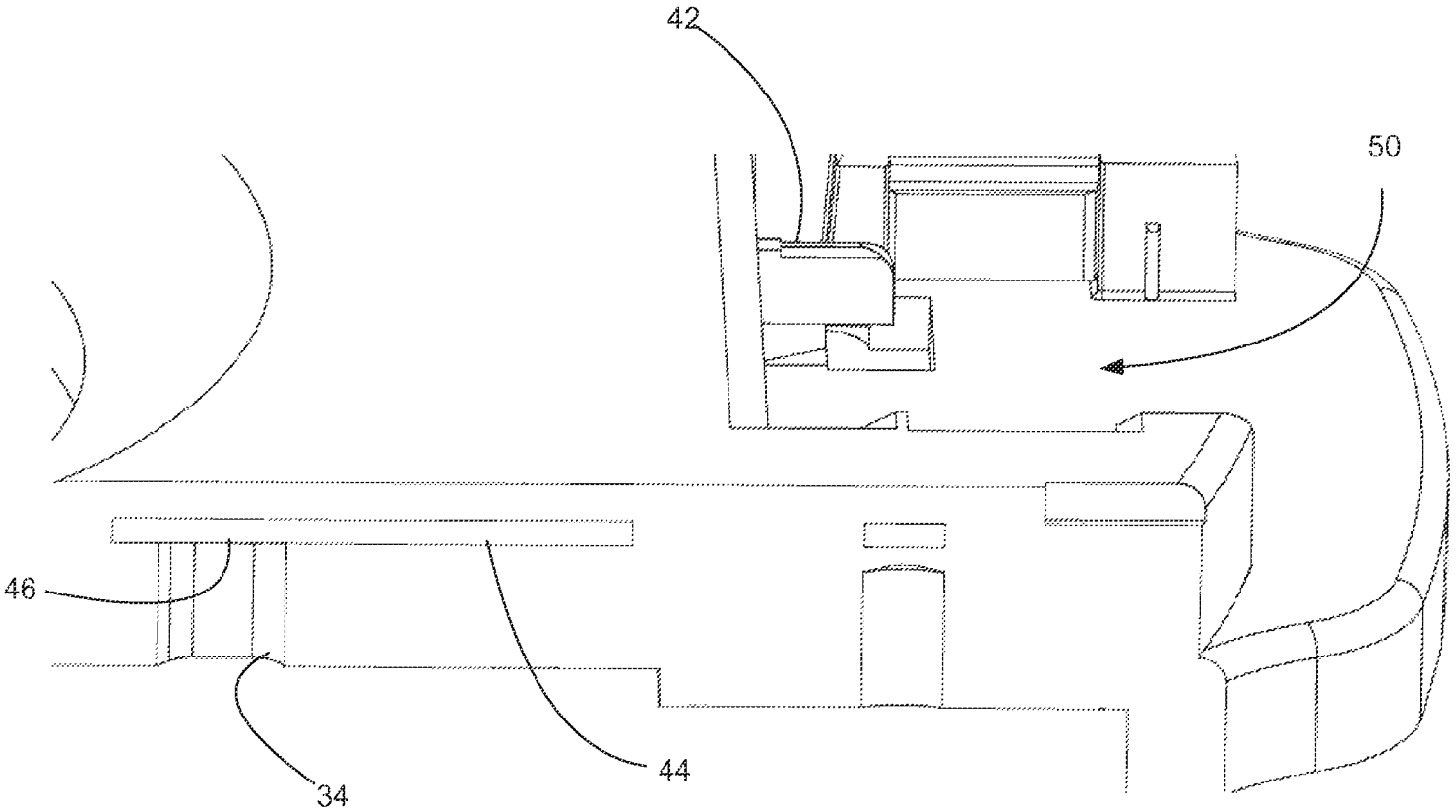
FIG. 5 illustrates a perspective view of a cross section taken along the line 5-5 in FIG. 3.
Figure 6:
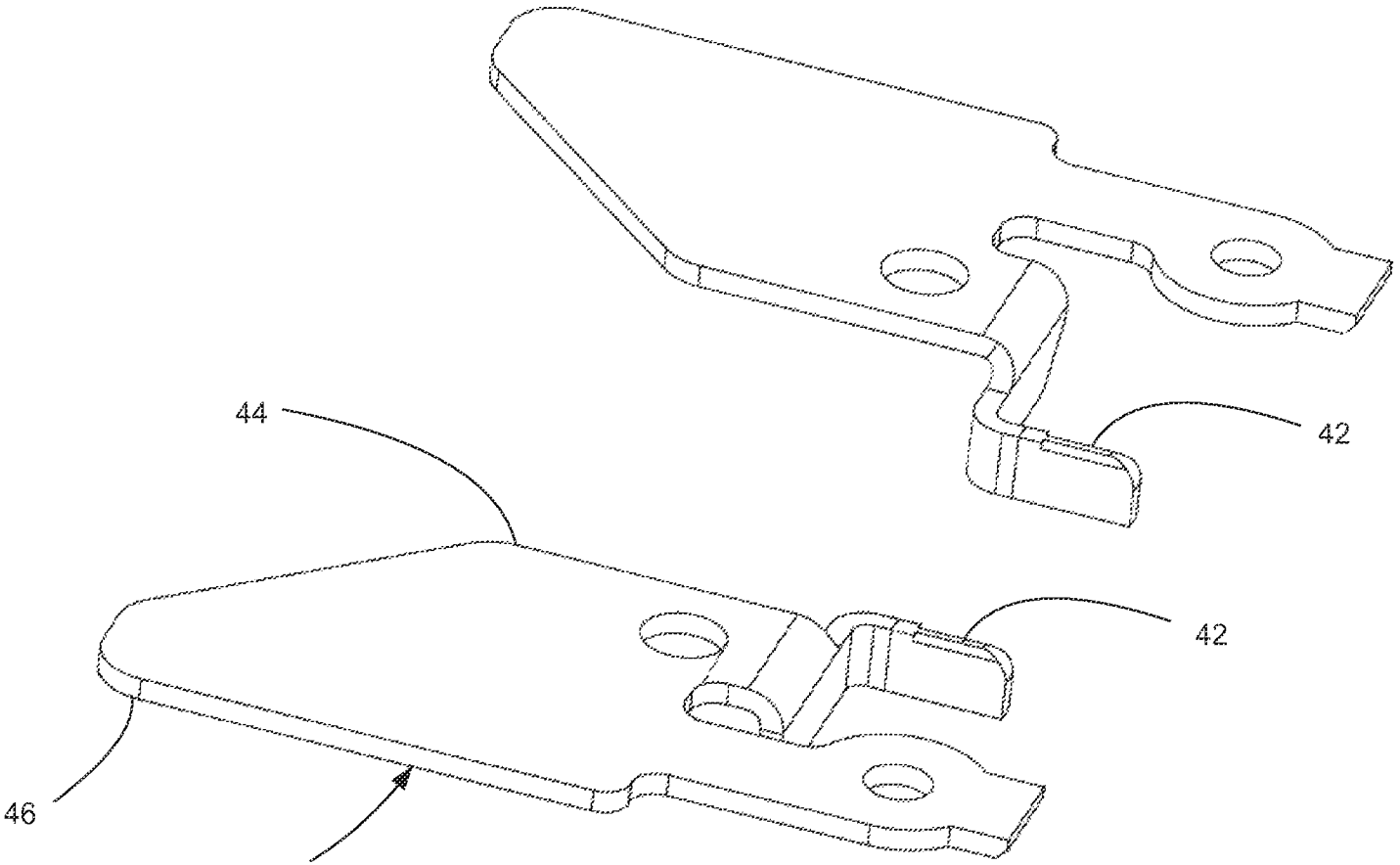
FIG. 6 illustrates a perspective view of an embodiment of terminals suitable for use in the holder depicted in FIG. 3.
Figure 7:
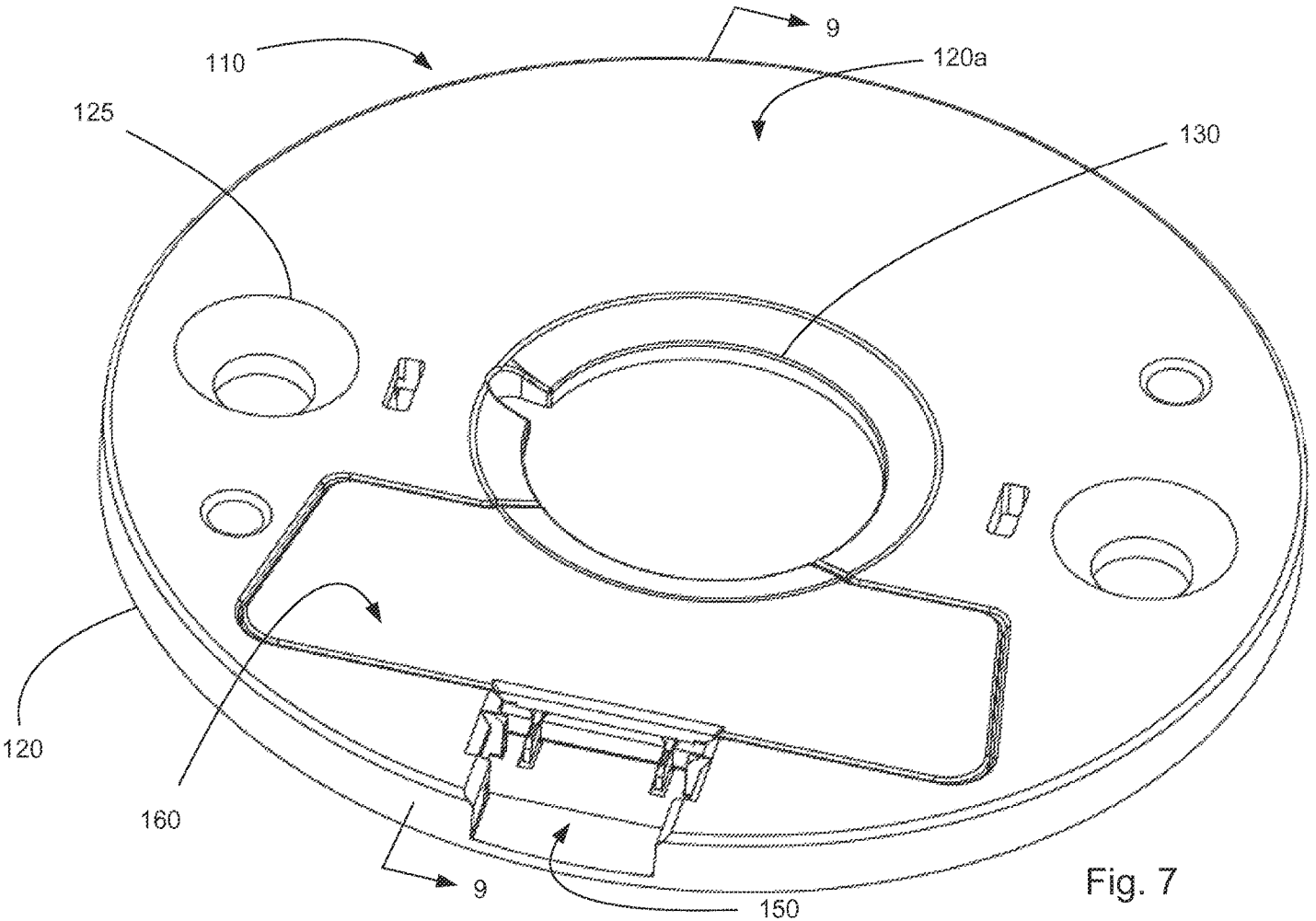
FIG. 7 illustrates a perspective view of a second embodiment of an LED holder.
Figure 8:
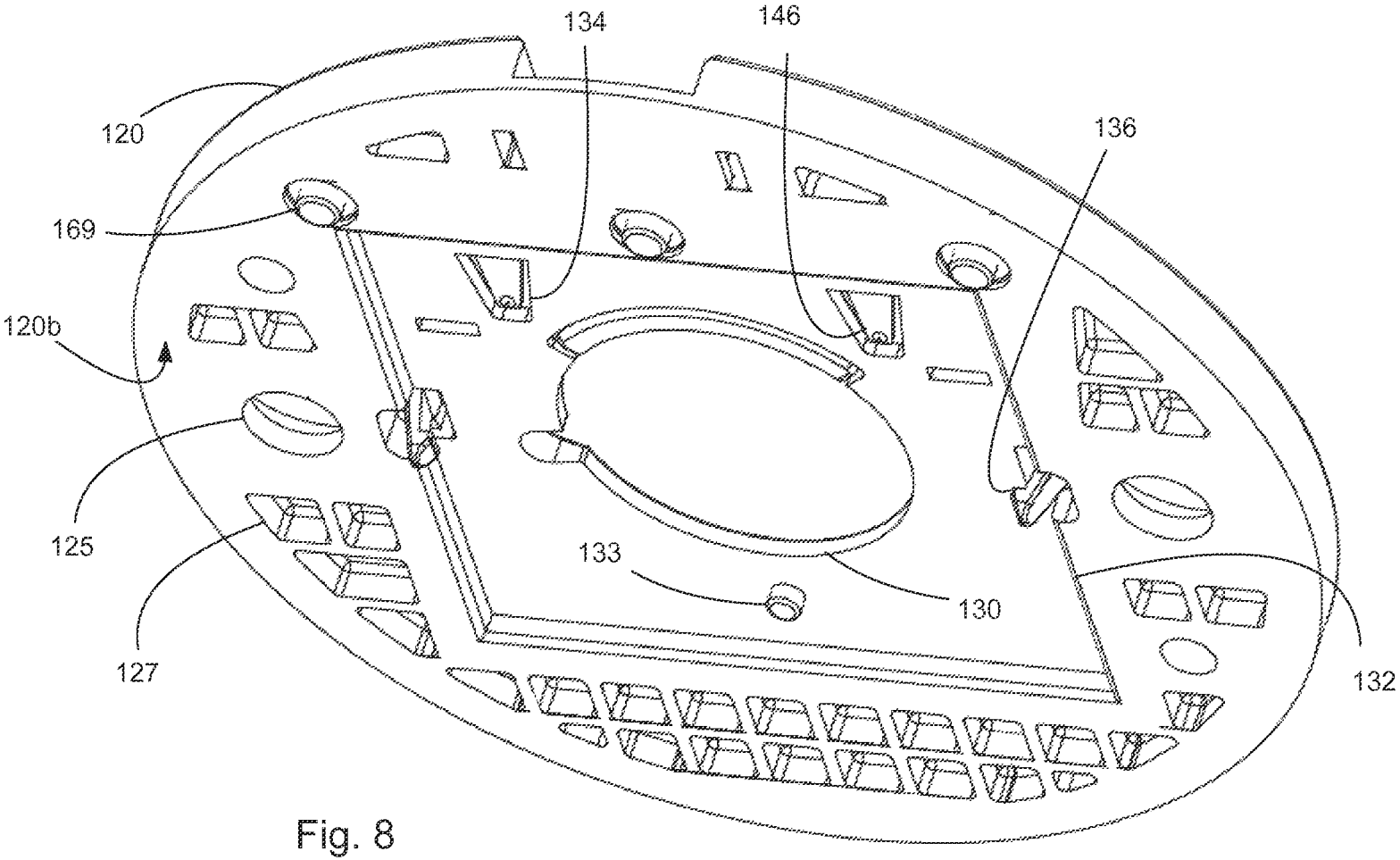
FIG. 8 illustrates another perspective view of embodiment depicted in FIG. 7.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

The features depicted in the figures can be used to provide desired functionality of a LED holder, which will vary depending on the application. It should be noted that as used herein, male contacts refer to contacts that are not intended to flex during mating and female contacts refer to contacts that are intended to flex during mating. It is understood, however, that all contacts will flex some minor amount when mating and that minuscule flexing is not sufficient to transform a male contact into a female contact.

The embodiment depicted in FIGS. 1-6, for example, allows for conductive epoxy to provide an electrical connection between a light emitting diode (LED) array and terminals in an LED holder. This, as can be appreciated, provides a system that should be relatively resistance to interruptions in any electrical connection due to the fact that the conductive epoxy provides a mechanical and electrical connection.

Turning to the Figs., an LED holder 10 includes a housing 20 with a light aperture 30 positioned internally and preferably closer to a center of the holder assembly. The housing 20 includes a lip 22 that is aligned with a receptacle 50 provided on a top surface 22*a* of the housing 20. As can be appreciated, the receptacle 50 is molded into the housing 20. Fasteners 12 can extend through fastener holes 25 and can be used to secure the holder assembly to a supporting surface (not shown). The receptacle 50 is provided that can receive a mating connector 15 that includes a housing 16 and two or more conductors 17. The depicted receptacle 50 include two male terminals 42, however additional terminals can be included if a corresponding light emitting diode (LED) array is configure to accept multiple power inputs/outputs.

A socket 32 is provided on a bottom surface 22*b*. The light aperture 30 is positioned in the socket 32 and the socket 32 includes pockets 34 that are configure to be aligned with pads on a corresponding LED array (not shown). Thus the position and size of the pockets will vary depending on the LED array that the holder is intended to secure.

Terminals 40 are insert molded into the housing 20 so that the body 44 is securely retained by the housing 20 while male contact 42 extends into the receptacle 50. Contact 46 is positioned at the pocket 34. Thus, with a conductive adhesive the contact 46 can be electrically connect to a corresponding pad on a corresponding LED array.

It should be noted that the terminals 40 only extend a short distance. This is useful because the terminals need to be supported during the molding process and typically a terminal will be secured by opposing fingers in the mold. Because of the small size of the terminals, limited holes are provided in the housing 20 and therefore the housing 20 has better performance from a creepage and clearance standpoint. If desired, it is easy to fill the holes in so as to avoid shorting paths and further improve creepage and clearance capabilities.

FIGS. 7-12 provide another embodiment of an LED holder 110. The LED holder 110 that includes terminals that press against contact pads on a corresponding LED array rather than be adhered to the pads. Such a design avoids the need to handle a conductive epoxy, which may be less desirable in certain manufacturing processes, and the design also helps provide good electrical separation such that more flexibility in the choice of a power supply is possible.

The LED holder 110 includes a housing 120 with a top surface 120*a* and a bottom surface 120*b*. The housing 120 includes fastener holes 125 and a receptacle 150 is molded into the housing 120. The housing 120 also include a light aperture 130 that is configured to allow light to pass through the holder. The housing 120 supports a shield 160 and the shield 160 can be secured to the housing 120 by heat staking posts 169.

The bottom side 120*b* of the housing 120 includes a socket 132 that can be sized to accept the corresponding LED array. One or more fingers 136 can be provided to help support the LED array in the socket 132 before the holder 110 is secured to a supporting surface. Alternatively, the socket can be configured so that the corresponding LED array has an interference fit with the socket and the fingers can be omitted. One advantage of the depicted design is that the fingers 136 allow for easy installation and retention of the LED array.

The socket 132 includes terminal apertures 134 that are configured to be aligned with pads on a corresponding LED array. Female contacts 146 extend through the terminal apertures 134 into the socket 132. To help ensure the LED array is correctly aligned, an orientation feature 133 can be provided that is matched to a corresponding orientation feature 133 in a corresponding LED array. While the depicted orientation feature 133 is a projection, a notch that is configured to receive a projection would also be effective.

As can be appreciated, a number of core-outs 127 are provided in the holder. While not required, the core-outs tend to ensure the molded holder has a more consistent dimensional arrangement.

The housing 120 includes a recess 152 and a ledge 156 is provided in the recess. The ledge 156 is in communication with a groove 154 that may include one or more crush ribs 155 that are configured to create an interference fit with the terminal 140 when a foot 147 is positioned in the groove 154. The ledge is also in communication with the terminal aperture 134, discussed above.

Figure 9:
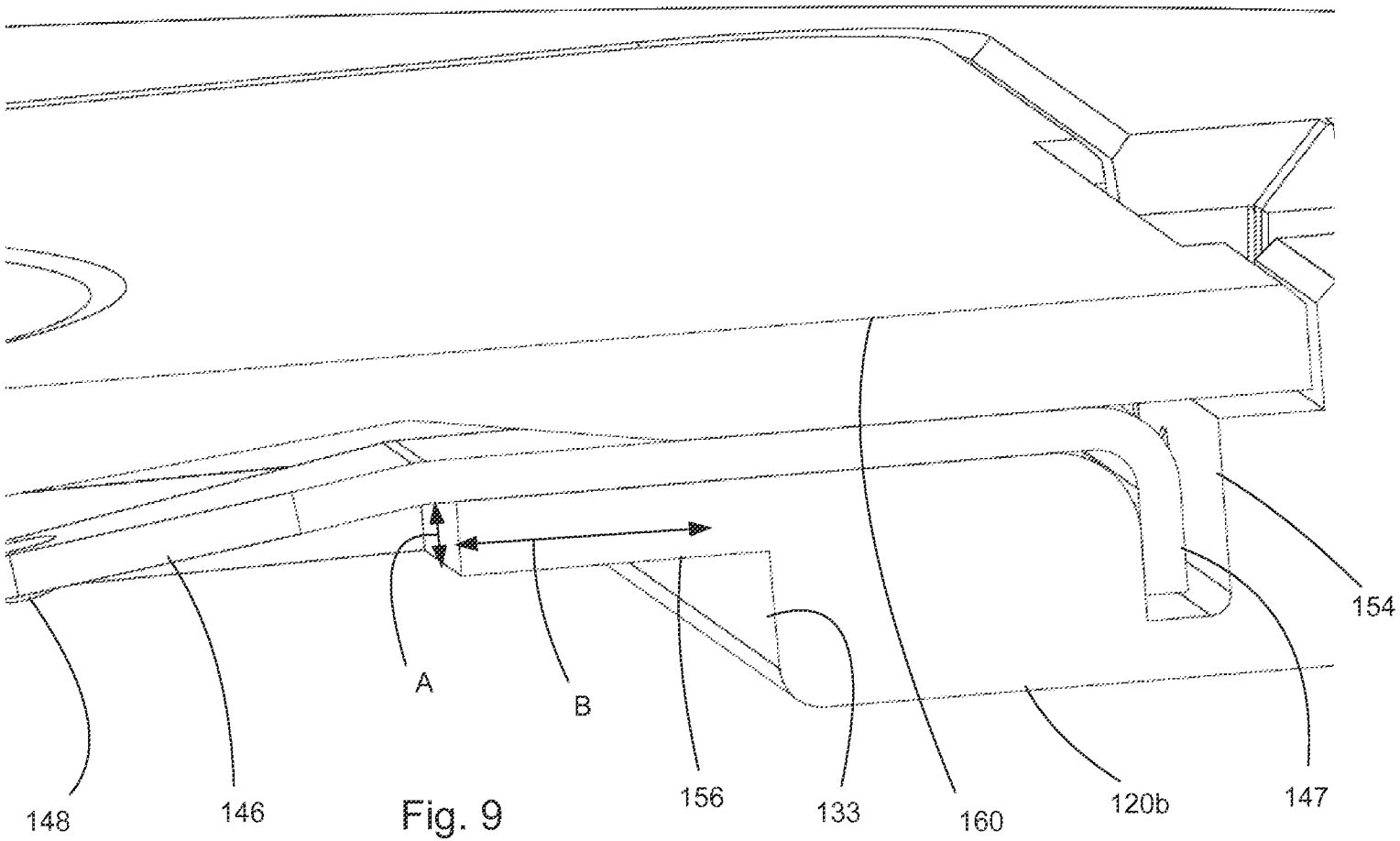
FIG. 9 illustrates a perspective view of a cross-section taken along line 9-9 in FIG. 7.
Figure 10:
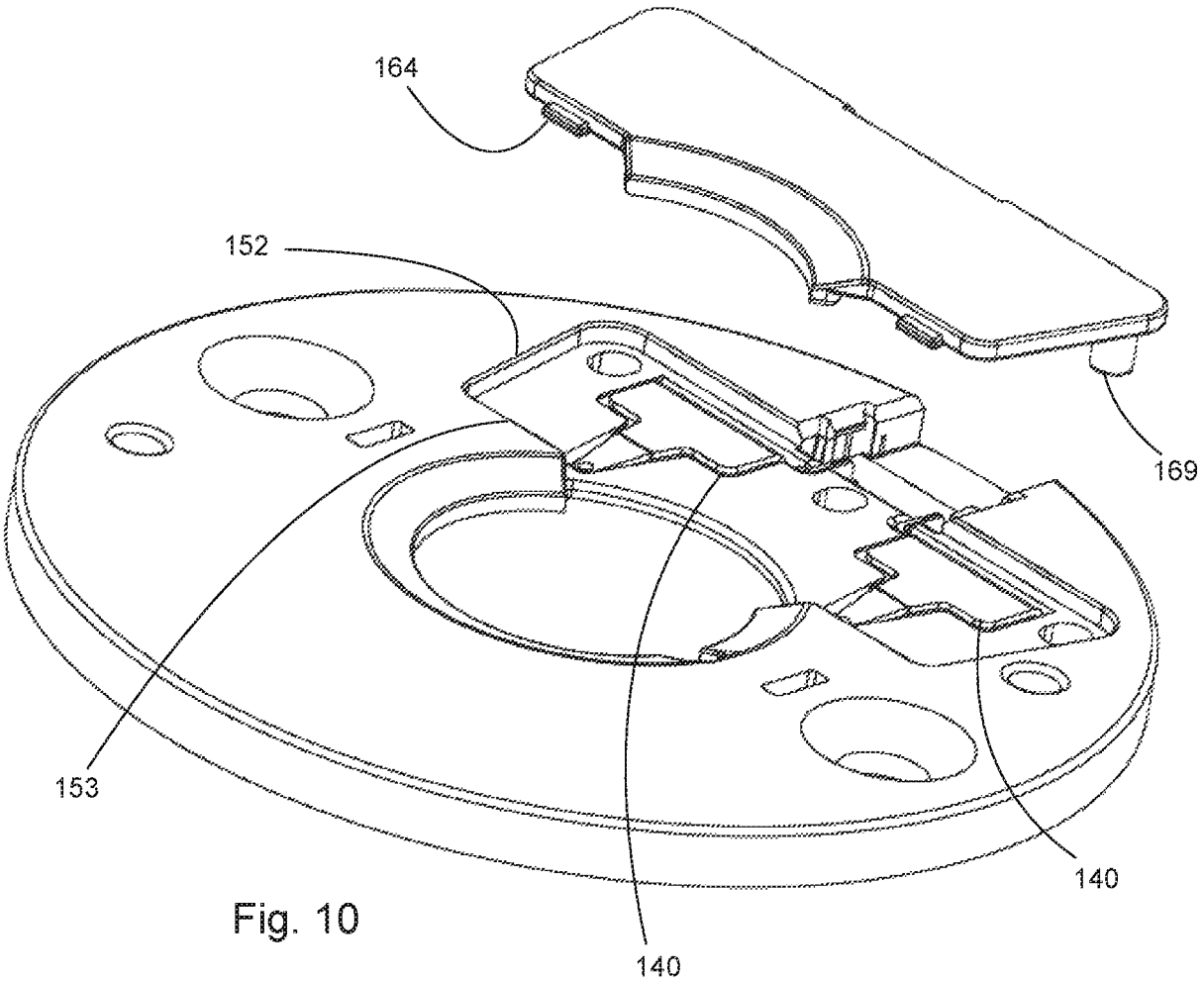
FIG. 10 illustrates a partially exploded perspective view of the holder depicted in FIG. 7.
Figure 11:
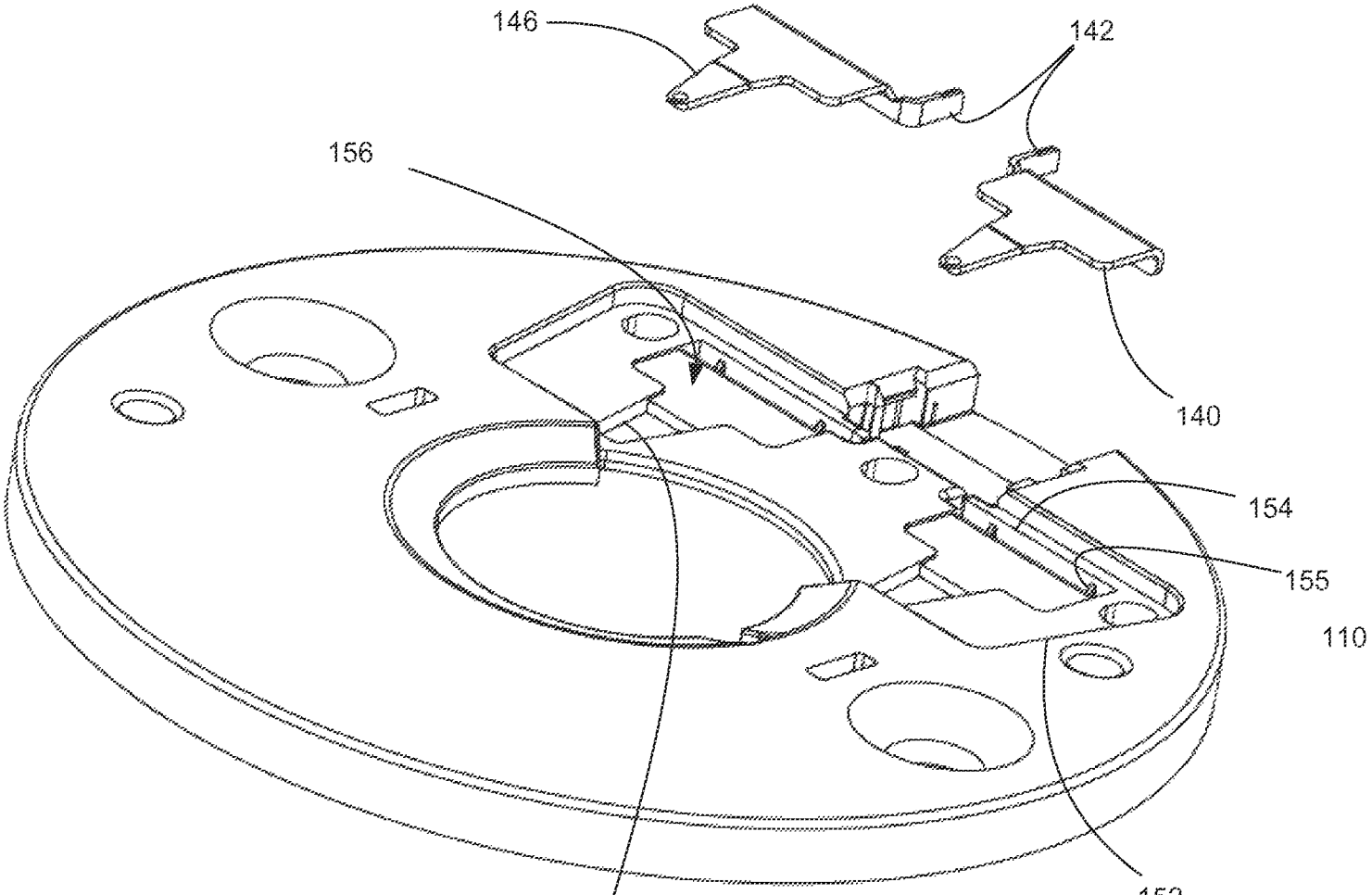
FIG. 11 illustrates a simplified further exploded perspective view of the embodiment depicted in FIG. 10.
Figure 12:
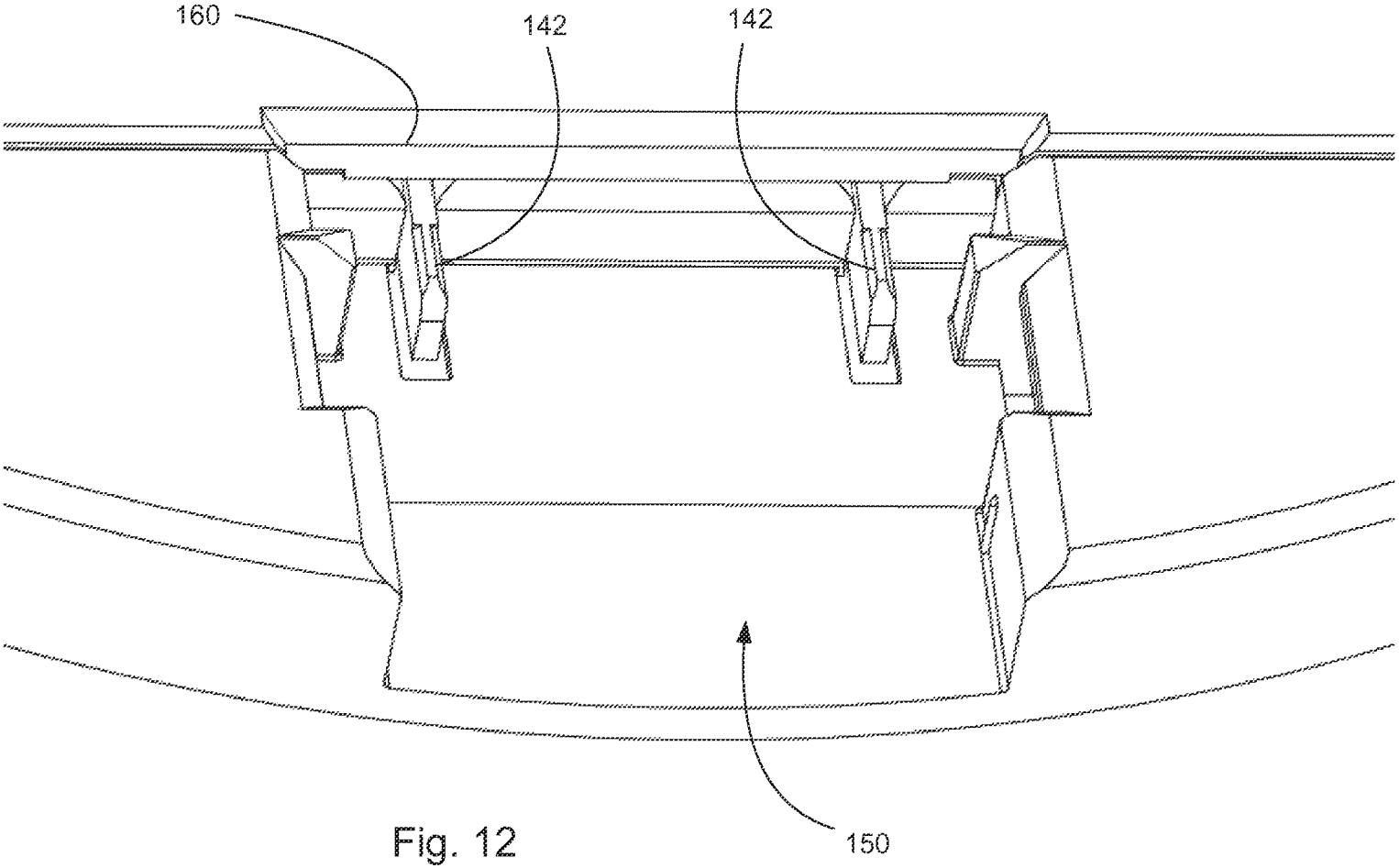
FIG. 12 illustrates an enlarged perspective view of a receptacle.

As can be appreciated from FIG. 9, the foot 147 is inserted into groove 154 so that female contact 146, which may include bump 148, extends into the terminal aperture 134. One thing of interest is that most LED arrays have a top surface that is covered by an insulative layer. Therefore the ledge 156 extends far enough such that vertical surface distance A plus horizontal surface distance B is sufficient to provide the desired creepage and clearance. In an embodiment the combination of A and B can between 1.5 mm and 2.5 mm. More preferably the combination of A and B can be about 2.0 mm. Generally speaking, there isn't as much benefit in providing surface distances beyond about 2.0 mm because 2.0 mm provides sufficient isolation for a majority of desirable power supplies that would be used in lighting applications but naturally additional distance can be provided, assuming the pad on the LED array is far enough away from the edge of the LED array. It should be noted that horizontal surface distance B may not extend all the way to edge 133 of the socket 132 as it is possible that the LED array may not have an insulative coating that extends to its edge.

As noted above, the shield 160 can be heat staked to the housing 120 via posts 169. The shield 160 can include a formed area that matches the surface of the light aperture 130. The shield 160 can also include shoulders 164 that are configured to engage an edge 153 so as to help secure the shield 160 in position. The shield 160, in turn, helps secure male contacts 142 in the receptacle 150. It should be noted that while male contacts 142 are preferred, in an alternative embodiment the male contacts could be provided as female contact. Thus a terminal could have a male and a female contact or two female contacts.

The disclosure provided herein describes features in terms of preferred and exemplary embodiments thereof. Numerous other embodiments, modifications and variations within the scope and spirit of the disclosed features will occur to persons of ordinary skill in the art from a review of this disclosure.

We claim:

1. A light emitting diode (LED) holder, comprising:

a housing formed of a insulative material, the housing having a light aperture, a recess with a first ledge and a second ledge, the recess including two terminal apertures and a receptacle formed into an edge of the housing;

a first terminal positioned on the first ledge;

a second terminal positioned on the second ledge, wherein the first and second terminal each have a contact that extends into the receptacle; and a shield positioned in the recess, the shield formed of an insulative material and covering the terminals.

2. The LED holder of claim 1, wherein the holder includes a pocket on a bottom surface of the housing, the pocket configured to receive a light emitting diode (LED) array.

3. The LED holder of claim 2, wherein the first and second terminals include female contacts that extend through the terminal apertures into the pocket.

4. The LED holder of claim 3, wherein the holder includes at least one retention finger configured to support an LED array.

5. The LED holder of claim 3, wherein the shield is heat-staked to the housing.

6. The LED holder of claim 3, wherein the pocket includes a projection configured to orientate a corresponding LED array.

7. The LED holder of claim 3, wherein the terminal includes a leg that is positioned in a groove provided in the housing.

8. The LED holder of claim 3, wherein the ledge is configured to provide between 1.5 mm and 2.5 mm of surface distance between the terminal and a potential short.

9. The LED holder of claim 8, wherein the ledge is configured to have a vertical surface distance and a horizontal surface distance that is between 1.9 mm and 2.1 mm.

* * * * *